United States Patent [19]

Moessinger et al.

[11] Patent Number: 4,544,001

[45] Date of Patent: Oct. 1, 1985

[54] WEFT YARN INTO THE SHED OF A WEAVING MACHINE

[75] Inventors: Albert Moessinger, Epalinges, Switzerland; Guy Gosciniak, Illfurth; Joël Angebault, Riedisheim, both of France

[73] Assignee: Societe Alasacienne de Construction de Materiel Textile, Mulhause, France

[21] Appl. No.: 561,337

[22] Filed: Dec. 14, 1983

[30] Foreign Application Priority Data

Dec. 17, 1982 [FR] France ..... 82 21506

[51] Int. Cl.[4] ..... D03D 47/12

[52] U.S. Cl. ..... 139/443; 139/453; 139/452

[58] Field of Search ..... 139/452, 453, 443

[56] References Cited

FOREIGN PATENT DOCUMENTS 2229879 6/1972 Fed. Rep. of Germany .
3105141 12/1981 Fed. Rep. of Germany ..... 139/443
1562147 2/1969 France .
2044192 2/1971 France .
2477587 3/1980 France .
2445865 8/1980 France .
2477192 9/1980 France .
2495196 11/1980 France .
2506795 12/1982 France .

*Primary Examiner*—Henry S. Jaudon
*Assistant Examiner*—S. Shongut
*Attorney, Agent, or Firm*—Parkhurst & Oliff

[57] ABSTRACT

The invention relates to a device for the preparation and insertion of at least one type of weft yarn into the shed of a weaving machine. The said device comprises a yarn metering-delivering member feeding a storage chamber used for temporarily storing a length of weft yarn before its insertion into the shed. The introduction of the weft yarn into the storage chamber and its extraction to be thrown by means of rotating rollers are effected via a single guiding channel which comprises a zone situated between the throwing rollers and close to the gripping line, said zone overlapping laterally with respect to the rollers and comprising a continuous longitudinal slot.

12 Claims, 8 Drawing Figures

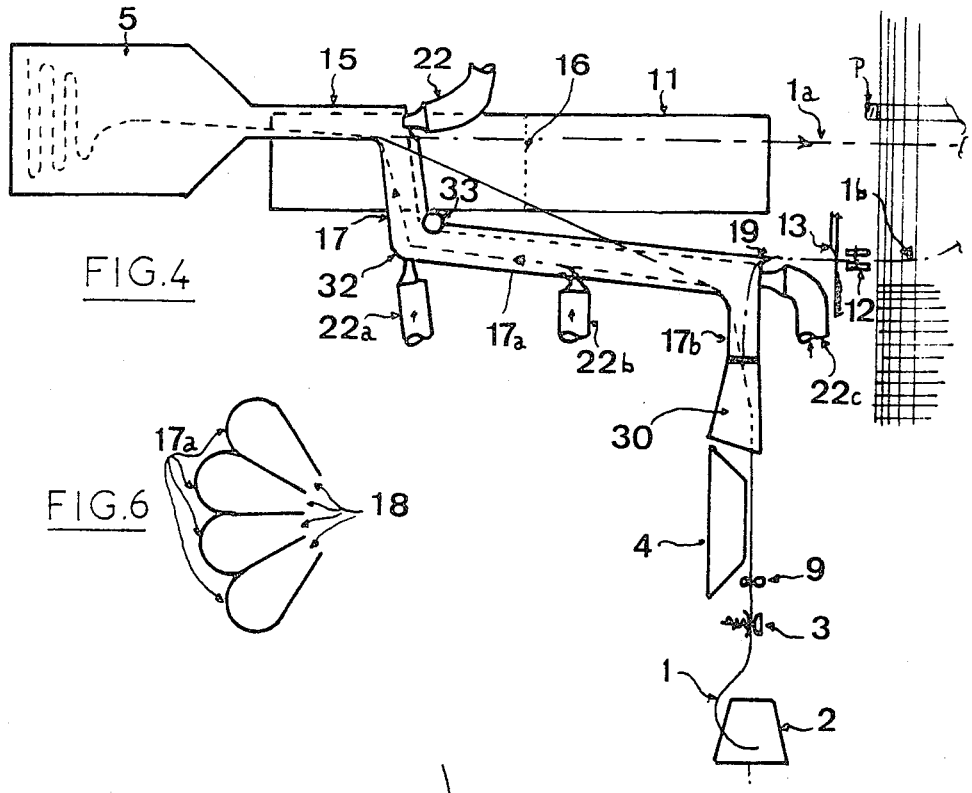
FIG.4
FIG.6
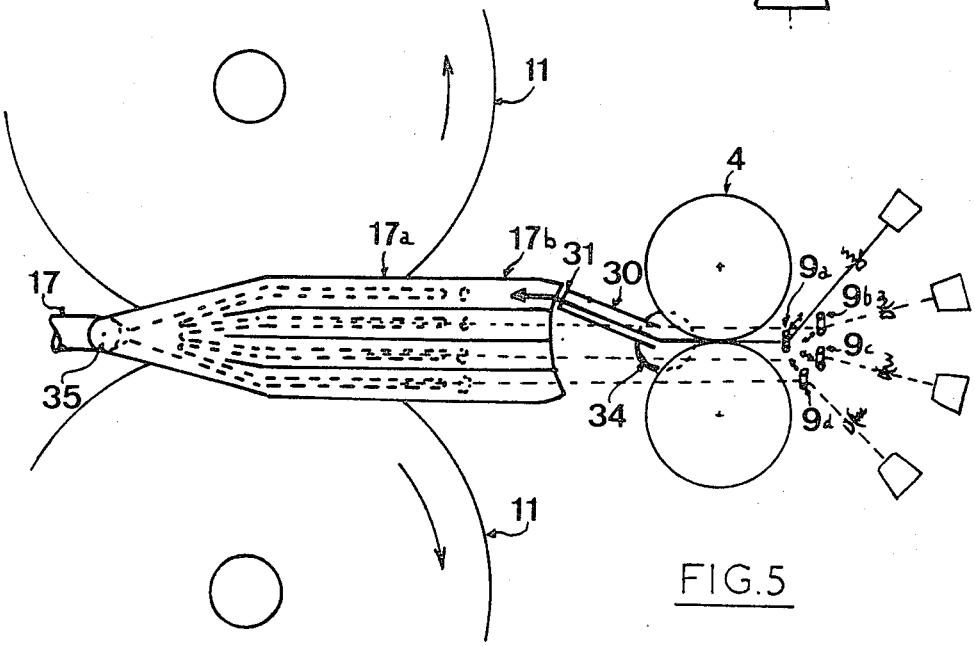
FIG.5

WEFT YARN INTO THE SHED OF A WEAVING MACHINE

The present invention concerns the textile industry and relates more particularly to weaving machines without shuttles, in which the weft is inserted into the shed formed by the warp yarns according to the technique known as "insertion by inertia", a technique described for example in French Pat. No. 1 562 147 (corresponding to U.S. Pat. No. 3 543 808), and in French patent applications published under Nos. 2 477 587 and 2 495 196.

In general, the throwing-by-inertia technique whereby the weft yarn is thrown into the shed in the form of a loop which unwinds, implies the preparation of the weft length before this is thrown. Such preparation consists in accumulating a length of yarn measured in a reserve situated between the yarn supply source (bobbin) and the side of the machine where the weft is due to be inserted, and then extracting the yarn from said reserve when it is about to be thrown. As described in French patent application Nos. 2 477 587 and 2 495 196, the extraction from the reserve can be carried out through the same channel as that through which the yarn was introduced, but in reverse. This therefore implies a change of path for the yarn during those displacements, first from the metering-delivering device to the reserve, and second, from the reserve to the throwing member.

This necessity is obvious from the teachings of French patent application No. 2 477 587. According to the solution described in said document, the change of path takes place without any special guiding, the yarn being thrown freely from one point to another to be thereafter deviated in another direction.

The technical solution described in the aforesaid document is very satisfactory but, considering that the yarn passes freely close to the throwing member and that in that area, perturbing air streams may occur, especially when the throwing member is of the type with rotating rollers, the position of the yarn may alter and the gripping of the yarn by the throwing member may be perturbed.

The object of the invention is to propose an improvement to the technique described in the aforesaid patent, which will not only eliminate the effect of disturbing air streams produced by the throwing rollers, this permitting to obtain always the same path for the yarn, but which will also permit to adapt this technique to the production of fabrics containing wefts of a different nature, inserted at a predetermined sequence, and to have only one reserve for the work of different wefts. It is also possible, according to the invention, to reduce wastes of yarns on the selvedge as well as to help the return of the weft end after it has been cut.

Therefore, the invention generally relates to a device permitting the preparation and insertion of at least one type of weft yarn into the shed of a weaving machine, said device comprising:

a metering-delivering device supplying weft yarns to a storage chamber or reserve used for temporary storing a predetermined length of weft yarn before its insertion into the shed;

means permitting to stop the action of the metering-delivering device when the length of yarn stored in the reserve is thrown, the weft being thrown in the form of a loop which unwinds, such loop being obtained due to the action of rotating rollers for example;

means for gripping and cutting the inserted weft yarn, which means are situated close to the selvedge of the fabric.

The device according to the invention is characterized by the fact that the introduction of the weft yarn into the storing chamber and its extraction therefrom in order to be thrown, take place through a single guiding channel, which is extended by a zone situated opposite the line along which the weft yarn is gripped between the throwing rollers and close to said line, the said zone overlapping laterally with respect to said rollers and comprising a continuous longitudinal split extending through to the inlet end of said channel.

Advantageously, the means used for operating the device according to the invention are of the type described in French patent application No. 2 477 587, and the storage chamber or reserve can be constituted in the same way as that described in French patent application No. 2 495 196.

Although according to a preferred embodiment of the device of the invention, the extended portion of the yarn guiding channel presents a split area over a small length, the inlet end of which is situated close to the throwing rollers, according to an improved variant, said split area may be extended by a likewise split area which extends towards the metering-delivering device; it can extend substantially in parallel to the yarn throwing axis reaching close to the weft gripping and cutting members situated close to the selvedge of the fabric. In the aforesaid embodiments, the guiding channel is advantageously curved, the center of curvature being opposite the split, which enables the yarn to automatically move away the under the effect of the tension to which it is subjected.

Optionally, the guiding channel could be curved in reverse but then, a retractable element such as a lug should be provided in the area of the center of curvature in order to prevent the yarn from coming out under its tension.

The invention is also found to be particularly appropriate to insert a plurality of wefts, the device according to the invention then being provided with a plurality of guiding channels, one for every type of yarn, which join up before the gripping means are reached, to issue into a storage chamber wherein a weft length is temporarily stored.

The invention will be more readily understood on reading the following description with reference to the accompanying drawings, in which:

FIGS. 4 and 7 show variants in which the yarn is pulled out by pneumatic means;

FIGS. 5, 6 and 8 illustrate two variants of a device according to the invention adapted for the insertion of different wefts.

Figure 1:
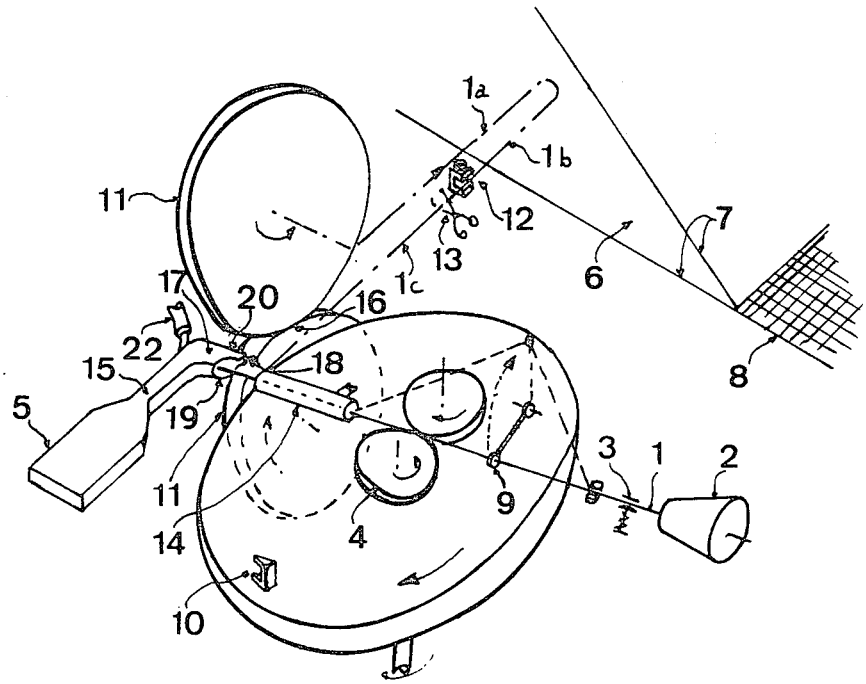
FIG. 1 is a diagrammatical perspective of a device according to the invention for inserting a single weft.
Figure 2:
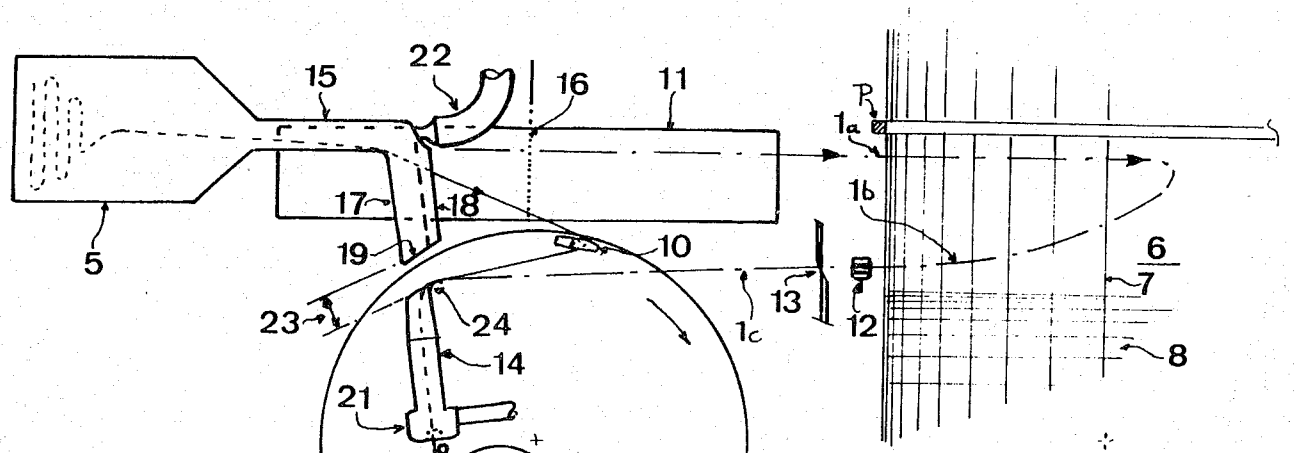
FIG. 2 is a plan view showing in more detail the different phases of insertion of a weft with the device of FIG. 1 wherein the yarn is mechanically pulled out.
Figure 3:
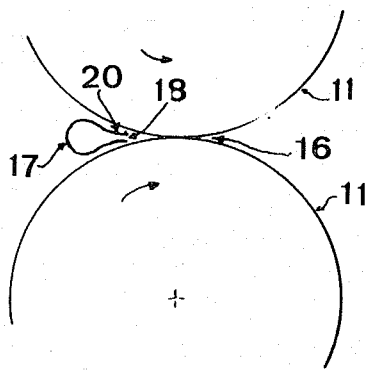
FIG. 3 is a detailed view of part of an embodiment of a guiding channel according to the invention.

Referring first to FIGS. 1 to 3, these show a device according to the invention adapted for the insertion of a single weft yarn.

According to this embodiment, the weft yarn (1) delivered by a bobbin (2) is called, after going through a stretching element (brake 3), via a metering-delivering device (4), in order to be introduced into a storage chamber (5) used for temporarily storing a predetermined length of weft yarn (1) before this is thrown into the shed (6) formed, on the one hand, by the warp yarns (7) which join up with the material (8) and, on the other hand, by the reed (P) (shown in FIG. 2). When the required length of weft yarn (1) has been fed into the storage chamber (5), the yarn is withdrawn from the action of the metering-delivering device (4), by moving a guide (9) for example. Then, in the same way as that described in French Pat. No. 2 477 587, the weft yarn is pushed laterally by a presenting member (10) and comes out of the guide (17) through an aperture (18) to be brought between two rotating rollers (11) (only the lower roller being shown in FIG. 2). Said rotating rollers (11) grip the yarn (1) which is thrown into the shed (6) in the form of a loop (shown in dash-and-dot lines in FIGS. 1 and 2) one strand of which (1*a*) moves at a speed which corresponds to the circumferential speed of the rollers (11), whilst the other strand (1*b*) is held back for example by the brake (3). When it reaches the shed, the held-back strand is immobilized by means of a clamp (12) situated close to the selvedge, then it is cut with scissors (13). During this particular operation, the guide (9) moves in order, first, to withdraw the yarn (1) from the action of the metering-delivering device (4) and then, after the cutting operation, to bring the end (1*c*) of the yarn inside the tube (14) where it is stored whilst the yarn length placed in the reserve (5) is thrown, the metering cycle starting again when the reserve (5) is empty.

In order to withdraw the yarn from the action of the perturbing air streams created by the rotation of the throwing rollers (11) and to obtain always the same position of the yarn during the throwing, the single channel (15) permitting the introduction of the weft yarn into the storing chamber (5) and its removal therefrom during the throwing operation, comprises a zone (17) overlapping laterally with respect to the throwing rollers (11), said zone facing the gripping line (16) of the rollers (11) (shown in dotted line in FIG. 2) and being close to said line, and presenting a continuous longitudinal slot (18) which extends as far as the inlet end (19) of said guiding channel. Owing to the presence of said split zone (17), the yarn is protected against the perturbing air streams, which protection can be further improved by providing on either side of slot (18) lips (20) reaching as close as possible to the gripping line (16).

And in order to obtain an accurate circulation of the yarn between the metering device (4) and the reserve (5), the guiding channels (14) and (15) are preferably connected with pneumatic nozzles (21–22). The nozzle (21) produces inside guiding channel (14), an air stream which pushes the yarn through the free zone (23) provided between the outlet end (24) of the tube(14) and the inlet (19) of the tube (17) so that the finger (10) of the presenting member can pass and grip the yarn to bring it to the throwing member.

As illustrated in the accompanying drawings, the split part (17) and the tube (15) connected with the storage chamber (5) form a rather sharp angle, the advantage of such a change in direction being to prevent all entanglement of the thrown yarn and to pull it out of the reserve(5) in a straight line during the throwing operation. In order to help the yarn to take this turn, when the reserve is being supplied, the nozzle (22) which is situated at the end of the feeding channel (15) injects air into said channel in the direction of the storage chamber (5).

It is important when using such jet nozzles, and in particular the nozzle (21) to be careful to avoid an excess of pressure in the split part (17), the effect of which would be to bring the yarn out during the metering operation, namely whilst the yarn is on its way from the metering device (4) to the reserve (5). Because of its disposition, the nozzle (22) not only helps the introduction of the yarn into the reserve (5), it also tends to suck in the air from the split zone (17) and in doing so, to create a depression therein. Also, the jet nozzles will preferably be combined with adjusting means (not shown), so that the suction performed by nozzle (22) in the split part (17) is greater than the air brought in through the nozzle (21).

FIGS. 4 and 5 illustrate a variant according to the invention which, not only can be used to throw a single weft yarn, but which can also be adapted for the insertion of a plurality of wefts in predetermined sequence.

According to this variant, the yarn (1) is pulled from the bobbin (2) and goes through a guiding member (9) situated upstream of the metering device (4).

As in the preceding embodiment, the reserve (5) comprises a single guiding channel (15) which is extended, in the zone facing the yarn gripping line (16), by a split part (17) overlapping laterally with respect to the throwing rollers (11). In the illustrated example, the split zone (17) is extended by a second part (17*a*) facing the side of the throwing rollers (11) and reaching close to the thread-cutting member (13). According to this variant, the yarn, after the metering operation, is thrown into a funnel (30) whose outlet is connected with the split tube (17*a*) via a conduit (17*b*). Thus, the length of the yarn from its emergence from the split tube (17*a*) up to the scissors (13) can be reduced, this permitting to reduce the time needed to return it into the tube (17*a*), which can be done by pneumatic means as explained hereinafter. Considering that in the present case, the split parts (17-17*a*) are facing inwardly (towards the center of curvature of the elbow 32), any tension in the yarn will therefore tend to push it out through the slots, which can interfere with its passage into the reserve (5). To reduce this problem, a checklug (33) is placed opposite the slot in the elbow part, said lug being retractable when the metering operation is over, so that the yarn kept stretched by the air stream from nozzle (22) can come out through the slot of zones (17) and (17*a*) and be brought on the generating line of grip (16) between the throwing rollers (11), so as to be thrown into the shed in the form of a loop, as illustrated in FIGS. 1 and 2. As in the other embodiment, the held strand (1*b*) penetrates into the side clamp (12) to be thereafter cut by scissors (13).

According to this embodiment, the passage of the yarn from the metering device (4) to the reserve (5) can be made easier by providing additional nozzles (22*a*-22*b*-22*c*) throughout the length of the split part (17-17*a*), this being designed to help the movement of the yarn along the tube whilst creating a depression which sucks in the ambient air through the slot.

Split parts (17-17*a*) are, in the illustrated case, arranged in such a way that the beginning (19) of the slot is close to the scissors (13). Thereafter, the yarn length delivered by the bobbin and cut, is carried by the stream from the nozzle (22*c*) and is thus held inside conduit (17*a*). When the yarn is delivered by the metering device (4), it follows its path along conduits (17*a*-17-15) to be stored in the reserve (5) and another cycle can start again.

It is possible with said pneumatic embodiment, to eliminate the withdrawal action performed by the guide (9) after the cutting operation, which action was necessary with the embodiment illustrated in FIGS. 1 and 2.

Such a solution is also particularly suitable when a plurality of weft yarns are worked in any order, as illustrated in FIGS. 5 and 6.

In that case, it is necessary to have as many guides (9) as there are different yarns and said guides (9) would then have to work selectively like the weft yarns and perform a yarn withdrawal movement which, according to FIG. 1 is rather large and corresponds to the distance between the scissors (13) and the end (24) of channel (14) (FIG. 2). Said relatively large movement involves mass strains which limit the speed of the weaving machine.

By eliminating this withdrawal movement, the guides (9) only perform very small movements to introduce the yarn between the rollers.

The force exerted by the air stream on the yarn is relatively small. If the yarn is perfectly cut, it can be moved without difficulty. Unfortunately, the yarn cutting operation is a delicate one and there is a risk of leaving a few fibers uncut, with the currently used cutting instruments. This may slow down if not altogether stop the movement of the yarn, so that said yarn will not follow the prescribed sequence of preparation. To overcome this, the yarn is withdrawn mechanically over a small distance in order to make sure to clear the two ends of the cut yarn, in the case of a faulty cut.

As illustrated in FIG. 5, when a plurality of wefts are due to be inserted according to a predetermined sequence, the installation is equipped with as many guiding elements (9) as there are bobbins. Said guides, designated (9*a*) through (9*d*) in FIG. 5 are in a temporary position, so that the yarn, stretched between its guide (9) and its corresponding conduit (17) passes next to the metering device (4) and the funnel (30) open on one side. The selected yarn guide, for example (9*a*) will then move towards the metering device (4) whereas the funnel, pivoting about an axis (34) will be positioned so as to communicate with the corresponding conduit (17*a*). Every one of said conduits receives a nozzle (22*c*) on the yarn inlet side in (19). The different conduits join up in (35) to issue into a single conduit corresponding to part (17) of FIG. 4 inside conduit (17).

FIG. 6 shows in more detail how the split tubes (17*a*) are arranged so that their slots are facing the yarn throwing plane in which the generating line of contact (16), the clamp (12) and the scissors (13) are situated.

The nozzles can be controlled in relation to the working cycle so that they deliver the right quantity of air at the right moment.

In the case where a plurality of weft yarns are inserted, the nozzles specific to each yarn are not supplied when the yarns are in their temporary position.

Figure 7:
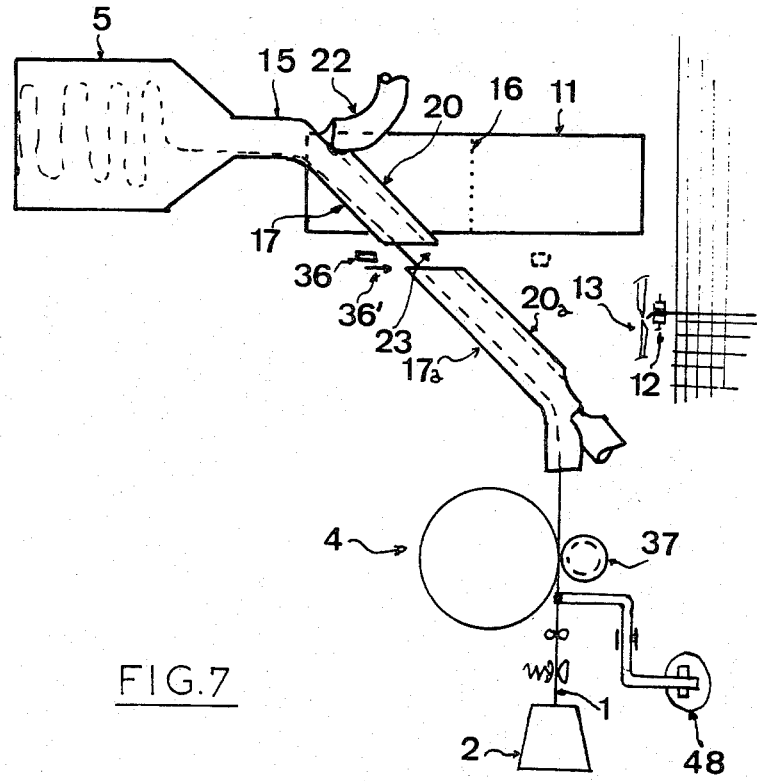
Figure 8:
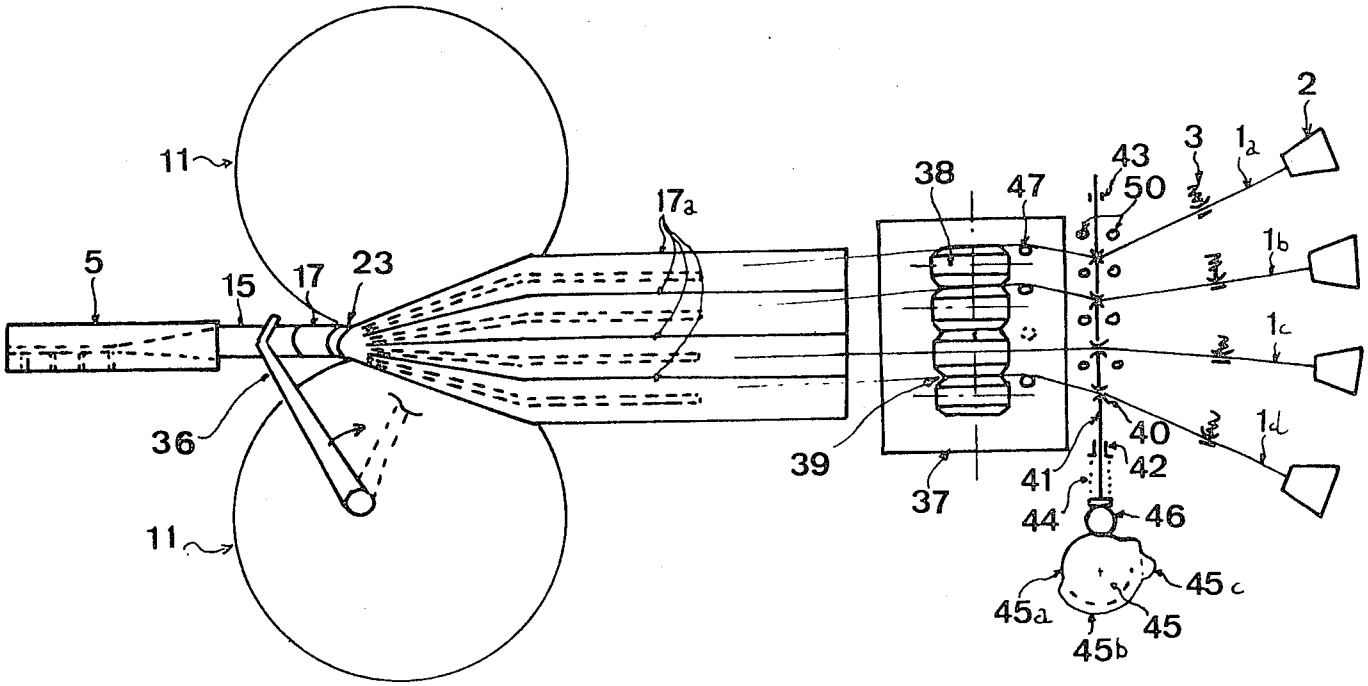

FIGS. 7 and 8 show another example of application of the invention permitting to insert different wefts according to a predetermined cycle. In this particular example, the split parts (17), (17*a*) are aligned on the same axis. It should be noted that the cut length of yarn going from the scissors (13) to the slot (20*a*) is smaller than the length of the channel (17*a*) and more precisely, smaller than the length of slot (20*a*) from its base to the interruption (23) provided in this case to allow the passage of the finger of the presenting member. According to this embodiment, the finger (36) of the presenting member suffers a rectilinear displacement and moves to-and-fro as illustrated by arrow (36'). Optionally, the path of the presenting member could, as illustrated in FIG. 1, be circular and following a continuous movement.

Each yarn (1*a*-1*b*-1*c*-1*d*) is pulled from one of the bobbins (2) and goes through a brake (3), then into a metering device (4) constituted, in this particular example, of a driven drum (37) and of pressure drums (38) formed by a succession of cylindrical parts (as many as there are yarns) separated by recesses (39). To every element formed by a cylindrical part (38) and a recess (39) corresponds a yarn-guide (40). Said guides (40) are integral with a bar sliding in bearings (42-43), said bar being subjected to the action of a spring (44) and of a cam (45) via a roller (46). The selection is obtained by means of studs (47) actuated by way of a normal selection control means (not shown) constituted for example by an electro-magnet (48) (see FIG. 7) or by a rod system from a dobby. In the example illustrated in FIG. 8, the stud (47) of the third yarn has been pressed in, and the yarn so selected and gripped between the drums of the supply means (4) is measured and sent into the reserve (5).

There is a possibility with this solution to increase cutting safety by mechanically pulling out a few centimeters of yarn in the same way as that explained hereinabove. In this case, the same guide (40) can be used, adding only a slight movement in a reverse direction to that in which the yarn is brought in the axis of the metering device. The yarn, entangled between the fixed studs (50) and the guide (40) will be pulled and broken in the part where it has been cut, if such cut is not a clean cut. In such a case, the cam (45) comprises three levels, level (45*a*) of yarn measurement (yarn of which the stud (47) is retracted and gripped between cylinders (37-38)),level (45*b*) permitting to move the yarn into the recess (39) said yarn awaiting to be picked up by the stud (47), whereas level (45*c*) creates the entanglement with the fixed studs (50) to give the lengthening necessary to break a yarn imperfectly cut.

The present invention is in no way limited to the description given hereinabove and on the contrary covers any other variants that can be brought thereto without departing from its scope, such as for example the adaptation of the device to multi-weft weaving.

What we claim is:

1. A device for the preparation and insertion of at least one weft yarn into the shed of a weaving machine, comprising:

a metering-delivering device for feeding weft yarn to a storage chamber for temporarily storing a predetermined length of weft yarn prior to insertion into the shed;

means for halting the feeding action of the metering-delivering device while the yarn stored in the storage chamber is being thrown into the shed;

rotating roller means for inserting the weft yarn by throwing a loop of the yarn stored in the storage chamber into the shed;

gripping and cutting means situated close to the selvedge of the fabric being woven for gripping and cutting the inserted weft yarn;

a guiding channel for guiding the weft yarn into and out of the storage chamber, said guiding channel comprising:

a first part extending from said storage chamber towards said rotating roller means and substantially in line with said rotating roller means, and a second part extending laterally from an end of said first part closest to said rotating roller means and further extending generally in the direction of said metering-delivering device, said second part having a continuous longitudinal slot formed on a side thereof closest to a gripping portion of said rotating roller means.

2. A device as claimed in claim 1, further comprising a plurality of such split guiding channels, each guiding channel having a weft yarn and said channels converging together before a point where a presenting member passes for moving a select one of the yarns passing through said guiding channels to be thrown by said rotating roller means.

3. A device as claimed in claim 1, wherein the guiding channel further comprises a third part extending from an end of said second part opposite said first part, and further extending close to said gripping and cutting means adjacent to the selvedge of the fabric, said third part also having a continuous longitudinal slot on a side thereof closest to said rotating roller means.

4. A device as claimed in claim 3, wherein a part of the yarn moving from the split guiding channel to the cutting means is returned into that channel by an air stream when the yarn is cut.

5. A device as claimed in claim 4, further comprising a plurality of guide channels for a plurality of weft yarns and wherein the end of the yarn re-introduced into the feeding channel does not reach a point where the different channels join together.

6. A device as claimed in claim 4, wherein the end of the cut yarn which is not gripped by the gripping means mechanically pulled out a few centimeters to release the ends of the cut yarn.

7. a device as claimed in claim 3, wherein the third part is curved with respect to said second part with a center of curvature situated on the side having the slot, so that the tension of the yarn moves said yarn away from said slot.

8. A device as claimed in claim 3, wherein said third part has a curvature whose center is on the side having the slot, means being provided to prevent the yarn from coming out through the slot under the effect of its own tension.

9. A device as claimed in claim 8, wherein the means provided to prevent the yarn from coming out through the slot under the effect of its tension comprises a retractable stud situated in front of the slot at the levvel of the center of curvature.

10. A device as claimed in claim 1, wherein at least one compressed air nozzle is provided, an air stream from the nozzle serving to transport and to hold the yarn inside the second part.

11. A device as claimed in claim 10, wherein a plurality of compressed air nozzles are provided in curved areas of guiding channel, the air streams delivered by these nozzles serving to direct the yarn inside said channel.

12. A device as claimed in claim 1, wherein said gripping and cutting means grips and cuts the slowest strand of the loop unwinding into the shed and wherein, after said cutting, said halting means also retracts an end of the yarn which is connected to a feeding bobbin close to a point where a presenting member carrying a new weft yarn towards the rotating roller means passes.

* * * * *